US005265672A

United States Patent [19]

Aoki

[11] Patent Number: 5,265,672

[45] Date of Patent: Nov. 30, 1993

[54] HEAT EXCHANGER

[75] Inventor: Hisao Aoki, Maebashi, Japan

[73] Assignee: Sanden Corporation, Gunma, Japan

[21] Appl. No.: 846,624

[22] Filed: Mar. 5, 1992

[30] Foreign Application Priority Data

Aug. 3, 1991 [JP] Japan ..... 3-012974[U]

[51] Int. Cl.[5] ..... F28F 9/02

[52] U.S. Cl. ..... 165/149; 29/890.052; 165/173; 228/183

[58] Field of Search ..... 165/149, 153, 173; 29/890.052; 228/183

[56] References Cited

U.S. PATENT DOCUMENTS 3,310,869 3/1967 LaPorte et al. ..... 29/157.3
4,569,390 2/1986 Knowlton et al. ..... 165/149
4,960,169 10/1990 Granetzke ..... 165/173

FOREIGN PATENT DOCUMENTS 58-164996 9/1983 Japan ..... 165/149

*Primary Examiner*—Allen J. Flanigan

*Attorney, Agent, or Firm*—Baker & Botts

[57] ABSTRACT

A heat exchanger includes a pair of substantially parallel header pipes and a plurality of substantially parallel tubes disposed between the pair of header pipes. Each tube defines a pair of end portions which are connected to the pair of header pipes. A plurality of rows of fins are provided along sides of the tubes. A pair of reinforcement members are provided along sides of each of the top and bottom rows of fins. Each of the pair of header pipes has a plurality of holes for inserting the end portions of the tubes to connect the tubes to each pipe of the pair of header pipes. At least one slit is formed on the end portions of each header pipe. The end portions of the reinforcement members extend through the slits to close the open ends of the header pipes. In one embodiment, each of the end portions of the reinforcement members extend through each header pipe through a pair of opposed slits and is bent to fix itself to the header pipe. The number of heat exchanger parts is thus reduced and the manufacture thereof is simplified.

14 Claims, 3 Drawing Sheets

HEAT EXCHANGER

TECHNICAL FIELD

The present invention relates to a heat exchanger, e.g., for use as a condenser and a radiator of an air conditioner for an automotive vehicle or the like.

BACKGROUND OF THE INVENTION

FIG. 5 shows a typical conventional heat exchanger which requires the heat exchange between a heat medium (for example, a cooling medium (refrigerant) or a brine) flowing in the heat exchanger and air passing through the heat exchanger. A heat exchanger, as shown in FIG. 5, is comprised of a pair of header pipes 1 extending in parallel relation to each other, a plurality of tubes 2 disposed between the header pipes and connected to the header pipes at their end portions, a plurality of radiation fins 3 provided on the sides of the tubes, a pair of reinforcement members 4 disposed on the top and bottom radiation fins, and brackets (not shown) for supporting the heat exchanger which are attached to the upper and lower portions of each header pipe.

Each header pipe 1 is constructed from a straight pipe having a circular cross section. A plurality of connection holes 11 are formed on the periphery of the header pipe with a predetermined pitch in the axial direction of the header pipe. The end portion of each tube 2 is inserted into a corresponding connection hole 11. Both ends of each straight pipe are closed by caps 1*a*. An inlet tube 1*b* for introducing the heat medium into the heat exchanger is connected to one of the header pipes 1, and an outlet tube 1*c* for delivering the heat medium out from the heat exchanger is connected to the other header pipe.

Tube 2 is formed as a straight tube which is flattened in the horizontal direction. The end portion of tube 2 is inserted into connection hole 11 of header pipe 1, and fixed therein by, for example, brazing. Corrugated type radiation fins 3 are fixed on the upper and lower surfaces of each tube 2 by, for example, brazing.

In the above construction of the heat exchanger, it is necessary to use four caps to close the open ends of header pipes 1 thereby adding to the number of parts of the heat exchanger.

In addition, the heat exchanger has to be preassembled before the heat exchanger is introduced into a furnace for brazing. Accordingly, it is necessary to use several jigs to fix tubes 2 and reinforcement members 4 to header pipes 1 in the preassembly of the heat exchanger, thereby complicating the process of assembling the heat exchanger.

Furthermore, reinforcement member 4 disposed on the surface of radiation fin 2 cannot be securely connected to header pipes 11 since the outer peripheral surface of header pipe 11 is curved. This arrangement thus fails to provide adequate overall strength of the heat exchanger.

SUMMARY OF THE INVENTION

It is an object of this invention to provide a heat exchanger with a small number of parts.

It is another object of this invention to provide a heat exchanger with a simple assembly process.

It is yet another object of this invention to provide a heat exchanger exhibiting improved overall structural strength.

A heat exchanger according to one embodiment of the present invention includes a pair of substantially parallel header pipes and a plurality of substantially parallel tubes disposed between the pair of header pipes. Each tube defines a pair of end portions which are connected to respective pipes of the pair of header pipes. A plurality of rows of fins are provided along sides of the tubes, including uppermost and lowermost rows of fins. A pair of reinforcement members are provided along side of each of the uppermost and lowermost rows of fins. Each pipe of the pair of header pipes has a plurality of holes into which the end portions of the tubes extend to connect the tubes to the respective pipes of the pair of header pipes. A pair of opposed slits is formed on at least one end portion of at least one header pipe. An end portion of at least one of the reinforcement members extends through the at least one header pipe through the pair of slits and closes off an adjacent end opening of the at least one header pipe.

In addition, a heat exchanger according to another embodiment of the present invention includes a pair of substantially parallel header pipes and a plurality of substantially parallel tubes disposed between the pair of header pipes. Each tube defines a pair of end portions which are connected to respective pipes of the pair of header pipes. A plurality of rows of fins are provided along sides of the tubes, including uppermost and lowermost rows of fins. A pair of reinforcement members are provided along sides of each of the uppermost and lowermost rows of fins. Each pipe of the pair of header pipes has a plurality of holes into which the end portions of the tubes extend to connect the tubes to each of the pipes of the pair of header pipes. A slit is formed on at least one end portion of at least one header pipe. An end portion of at least one of the reinforcement members extends into the at least one header pipe through the slit and closes off an adjacent end opening of the at least one header pipe.

A process for manufacturing a heat exchanger in accordance with the present invention comprises the following steps. A pair of open-ended header pipes is provided, each having a plurality of holes along its length and a slit at each of opposite end portions thereof. An assembly of a plurality of substantially planar tubes and a plurality of rows of fins extending along the tubes is secured between the pair of header pipes by inserting opposite end portions of the plurality of tubes into respective holes of the plurality of holes in the header pipes. Reinforcement members are secured between the pair of header pipes and along uppermost and lowermost rows of fins by inserting opposite end portions of the reinforcement members into respective ones of the slits and into each said header pipe such that the open ends of the header pipes are closed off by the end portions of the reinforcement members. The assembled header pipes, tubes, fins and reinforcement members are then brazed together.

Further objects, features and aspects of this invention will be apparent and fully understood from the following detailed description of the preferred embodiments of this invention, taken in connection with the attached drawings.

DETAILED DESCRIPTION OF THE PREFERRED EMBODIMENTS

Figure 1:
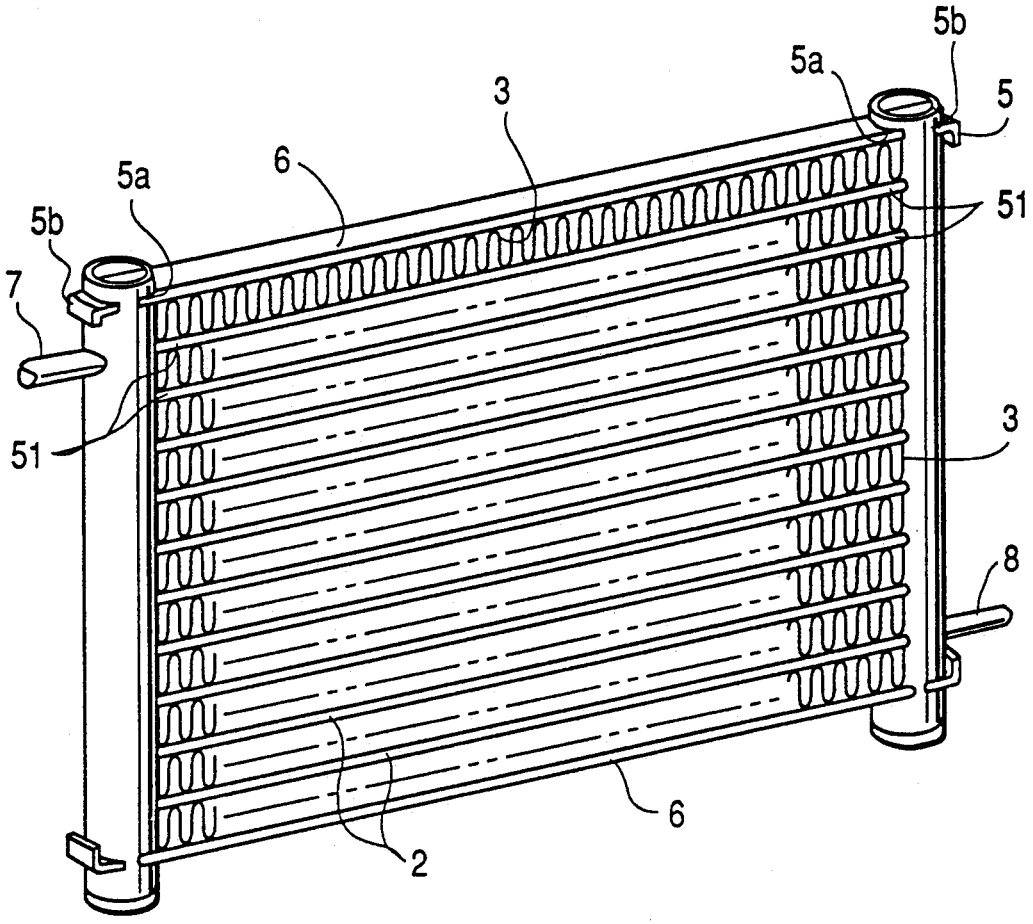
FIG. 1 is a perspective view of a heat exchanger of an automotive air conditioning system according to a first embodiment of the present invention.
Figure 2:
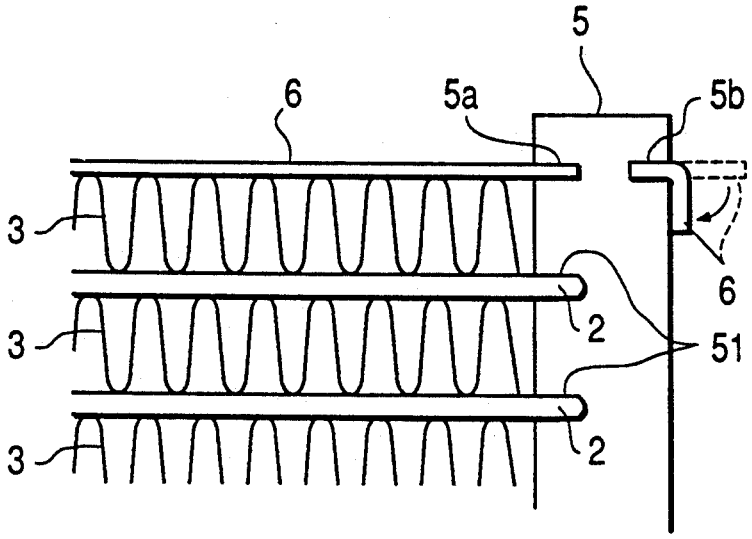
FIG. 2 is a close-up explanatory view of a part of the heat exchanger shown in FIG. 1.
Figure 3A:
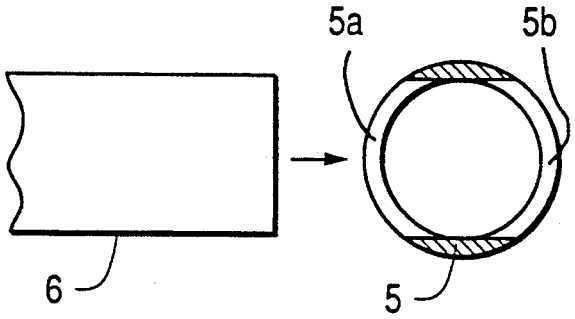
FIGS. 3(*a*) and 3(*b*) are close-up explanatory views of the connection portion of the header pipe and the reinforcement member of the heat exchanger shown in FIG. 1.
Figure 3B:
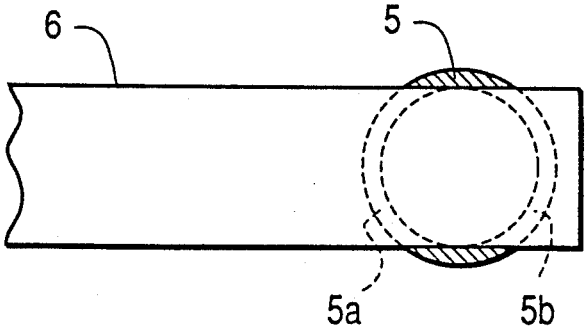

Referring to the drawings, FIGS. 1–3 illustrate a heat exchanger according to a first embodiment of the present invention. In FIG. 1, a heat exchanger has a pair of header pipes 5 extending in parallel relation to each other. Header pipes 5 have a plurality of connection holes 51 and slits 5*a* and 5*b* with a predetermined pitch arranged in the longitudinal direction thereof. A plurality of substantially parallel tubes 2 are disposed between the pair of header pipes 5. The tubes 2 are formed as flat tubes in this embodiment. The tubes 2 are connected at their end portions to respective pipes of the pair of header pipes 5. A plurality of corrugate type radiation fins 3 are provided on the sides of flat tubes 2 and fixed to the flat tubes by, for example, brazing. Reinforcement members 6 are provided on the upper surface of the top (uppermost) row of radiation fins 3 and the lower surface of the bottom (lowermost) row of radiation fins 3, respectively. The reinforcement members 6 are fixed to the upper and lower surfaces of the respective rows of radiation fins and the sides of header pipes 5. An inlet tube 7 is connected to the upper portion of one of the header pipes 5, and an outlet tube 8 is connected to the lower portion of the other header pipe. A heat medium (for example, a cooling medium or a brine) is introduced through inlet tube 7, flows through header pipes 5 and flat tubes 2, and flows out of outlet tube 8.

Connection holes 51 are formed along the peripheral surfaces of header pipes 5 for insertion of the end portions of tubes 2. Slits 5*a* are also formed on the peripheral surfaces of header pipes 5, at upper and lower end portions thereof, in alignment with connection holes 51. Slits 5*b* are formed on peripheral end surfaces of header pipes 5 in opposition to slits 5*a*. The width of slits 5*a* and 5*b* is equal to the inner diameter of header pipes 5 and the width of reinforcement members 6. As illustrated in FIGS. 3(*a*) and 3(*b*), in the assembly process of the heat exchanger, both end portions of tubes 2 are inserted into header pipes 5 through connection holes 51. Fins 3 are disposed between the upper and lower surfaces of each of tubes 2. Both end portions of reinforcement members 6 extend outwardly through header pipes 5 through slits 5*a* and 5*b*, and are bent downwardly to extend in an axial direction along the outer peripheral surface of header pipe 5. Accordingly, the end portions of reinforcement members 6 close off the end openings of header pipes 5 without the need for separate caps, and securely fix tubes 2 and fins 3 to header pipe 5 without using any jigs before brazing.

Figure 4:
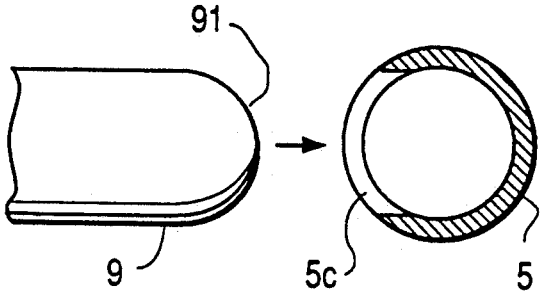
FIG. 4 is a close-up explanatory view of the connection portion of the header pipe and the reinforcement member of a heat exchanger in accordance with a second embodiment of this invention.
Figure 5:
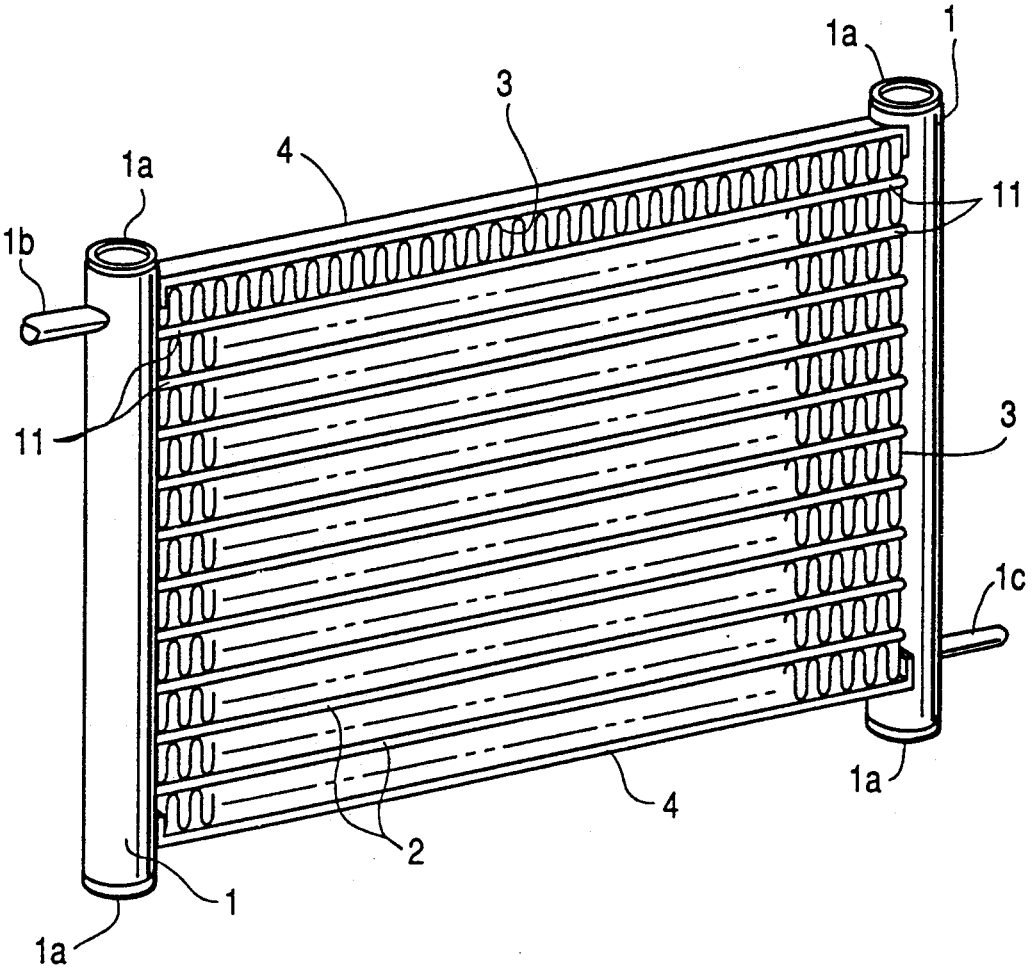
FIG. 5 PRIOR ART
FIG. 5 is a perspective view of a heat exchanger of a conventional automotive air conditioning system.

FIG. 4 illustrates a connection portion of the header pipe and the reinforcement member of a heat exchanger in accordance with a second embodiment of this invention described below.

Connection holes 51 are formed as mentioned above. Slits 5*c* are formed at both end portions of header pipes 5 in alignment with connection holes 51, respectively. The width of slits 5*c* is equal to the inner diameter of header pipe 5 and the width of reinforcement members 9. The end portions 91 of reinforcement members 9 are formed in a semicircular shape to correspond with the inner annular peripheral surfaces of header pipes 5. The end portions 91 of reinforcement members 9 are inserted into header pipes 5 through slits 5*c* until the end portions 91 contact (abut with) the inner annular surfaces of header pipes 5. Accordingly, the end portions of reinforcement members 9 close the open ends of header pipes 5, similar to the first embodiment.

This invention has been described in detail in terms of presently preferred embodiments thereof. It will be understood by those skilled in the art that many variations on and modifications of the preferred embodiments are also within the scope of this invention as defined by the appended claims.

I claim:

1. In a heat exchanger including a pair of substantially parallel header pipes; a plurality of substantially parallel tubes disposed between said pair of header pipes, each said tube defining a pair of end portions connected to respective pipes of said pair of header pipes; a plurality of rows of fins provided along sides of said tubes, including uppermost and lowermost rows of fins; and a pair of reinforcement members provided along sides of each of said uppermost and lowermost rows of fins, each pipe of said pair of header pipes having a plurality of holes, said end portions of said tubes extending into said holes to connect said tubes to the respective pipes of said pair of header pipes, the improvement comprising:

at least one end portion of at least one header pipe having a slit formed thereon, an end portion of at least one reinforcement member extending into said at least one header pipe through said slit and closing off an adjacent end opening of said at least one header pipe.

2. The heat exchanger of claim 1, wherein said end portion of said at least one reinforcement member has a semicircular shape corresponding to and abutting with an inner annular peripheral surface of said at least one header pipe.

3. The heat exchanger of claim 1, wherein the width of said at least one reinforcement member is substantially equal to the width of said slit and the inner diameter of said at least one header pipe.

4. The heat exchanger of claim 1, wherein each end portion of each header pipe has a slit formed thereon, and each end portion of each reinforcement member extends into a respective slit to close off four end openings of said pair of header pipes.

5. The heat exchanger of claim 4, wherein each end portion of each reinforcement member has a semicircular shape corresponding to and abutting with an inner annular peripheral surface of a respective header pipe.

6. The heat exchanger of claim 4, wherein the width of each reinforcement member is substantially equal to the width of each slit and the inner diameter of each header pipe.

7. In a heat exchanger including a pair of substantially parallel header pipes; a plurality of substantially parallel tubes disposed between said pair of header pipes, each said tube defining a pair of end portions connected to respective pipes of said pair of header pipes; a plurality of rows of fins provided along sides of said tubes, including uppermost and lowermost rows of fins; and a pair of reinforcement members provided along sides of each of said uppermost and lowermost rows of fins, each pipe of said pair of header pipes having a plurality of holes, said end portions of said tubes extending into said holes to connect said tubes to the respective pipes of said pair of header pipes, the improvement comprising:

at least one end portion of at least one header pipe having a pair of opposing slits formed thereon, an end portion of at least one reinforcement member extending through said at least one header pipe through said slits and closing off an end opening of said at least one header pipe.

8. The heat exchanger of claim 7 wherein said end portion of said at least one reinforcement member extends outwardly of said at least one header pipe through said slits, and is bent to fix itself to said at least one header pipe.

9. The heat exchanger of claim 7, wherein each end portion of each header pipe has formed thereon a pair of opposing slits, and each end portion of each reinforcement member extends through a respective pair of opposing slits to close off four end openings of said pair of header pipes.

10. The heat exchanger of claim 9, wherein each end portion of each reinforcement member extends outwardly of a respective header pipe through a respective pair of slits, and is bent to fix itself to a respective header pipe.

11. The heat exchanger of claim 9, wherein the width of each reinforcement members is substantially equal to the width of each of said slits and the inner diameter of said header pipes.

12. A process for manufacturing a heat exchanger, comprising the steps of:

providing a pair of open-ended header pipes, each having a plurality of holes along its length and at least one slit at each of opposite end portions thereof;

securing an assembly of a plurality of substantially parallel tubes and a plurality of rows of fins extending along said tubes between the pair of header pipes by inserting opposite end portions of said plurality of tubes into respective holes of said plurality of holes in said header pipes;

securing respective reinforcement members between the pair of header pipes and along uppermost and lowermost said rows of fins by inserting opposite end portions of said reinforcement members into respective ones of said slits and into each said header pipe such that the open ends of said header pipes are closed off by respective end portions of the reinforcement members; and brazing together the assembled header pipes, tubes, fins and reinforcement members.

13. A process according to claim 12, wherein said opposite end portions of the reinforcement members are inserted to extend outwardly of said header pipes through pairs of opposed slits provided at each end portion of each header pipe and are then bent to fix the reinforcement members between the pair of header pipes prior to brazing.

14. A process according to claim 12, wherein each said opposite end portion of each reinforcement member is inserted into a respective slit such that a semicircular shape thereof corresponds to and abuts with an inner annular peripheral surface of a respective header pipe to close off the open ends of said pair of header pipes.

* * * * *